US007126287B2

(12) United States Patent
Ballenger et al.

(10) Patent No.: US 7,126,287 B2
(45) Date of Patent: Oct. 24, 2006

(54) LAMP WITH INTEGRAL VOLTAGE CONVERTER HAVING PHASE-CONTROLLED DIMMING CIRCUIT WITH FUSE-RESISTOR NETWORK FOR REDUCING RMS LOAD VOLTAGE

(75) Inventors: Matthew B. Ballenger, Lexington, KY (US); George B. Kendrick, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 40 days.

(21) Appl. No.: 10/967,745

(22) Filed: Oct. 16, 2004

(65) Prior Publication Data

US 2006/0082328 A1 Apr. 20, 2006

(51) Int. Cl.
*H05B 39/04* (2006.01)

(52) U.S. Cl. ..... 315/291; 315/224; 315/225; 315/194

(58) Field of Classification Search ..... 315/291
See application file for complete search history.

(56) References Cited

U.S. PATENT DOCUMENTS 3,816,794 A * 6/1974 Snyder ..... 315/194
3,869,631 A 3/1975 Anderson et al. ..... 313/217
5,604,411 A * 2/1997 Venkitasubrahmanian et al. ..... 315/307
5,740,021 A * 4/1998 Lecheler et al. ..... 363/37
6,127,788 A * 10/2000 Yamamoto et al. ..... 315/307
6,220,718 B1 * 4/2001 Burgess ..... 362/101
6,445,133 B1 9/2002 Lin et al. ..... 315/57
6,870,327 B1 * 3/2005 Takahashi et al. ..... 315/248
6,977,472 B1 * 12/2005 Matsubayashi et al. ..... 315/291
2004/0195977 A1 * 10/2004 Fischer et al. ..... 315/225
2004/0212324 A1 * 10/2004 Callahan ..... 315/312
2005/0104543 A1 * 5/2005 Kazanov et al. ..... 315/294

* cited by examiner

*Primary Examiner*—Wilson Lee
*Assistant Examiner*—Binh Van Ho
(74) *Attorney, Agent, or Firm*—Carlo S. Bessone

(57) ABSTRACT

An incandescent lamp includes a lamp voltage conversion circuit within the lamp and connected to a lamp terminal, where the voltage conversion circuit converts a first line voltage at the lamp terminal to a second RMS load voltage usable by a light emitting element of the lamp. The voltage conversion circuit includes a triac phase-controlled dimming circuit, which in turn includes plural resistors connected to each other in parallel, each of the resistors being series-connected to a respective fuse, each of which has a different breaking current corresponding to voltage present at the line. A resistance in the phase-controlled dimming circuit is fixed by breaking at least one fuse in response to the first voltage. The voltage conversion circuit may be an integrated circuit that is in the lamp base and connected between the lamp terminal and the light emitting element.

13 Claims, 6 Drawing Sheets

LAMP WITH INTEGRAL VOLTAGE CONVERTER HAVING PHASE-CONTROLLED DIMMING CIRCUIT WITH FUSE-RESISTOR NETWORK FOR REDUCING RMS LOAD VOLTAGE

BACKGROUND OF INVENTION

The present invention is directed to a lamp with an integral voltage converter that converts line voltage to a voltage suitable for lamp operation.

Some lamps operate at a voltage lower than a line (or mains) voltage of, for example, 120V or 220V, and for such lamps a voltage converter that converts line voltage to a lower lamp operating voltage must be provided. The voltage converter may be provided in a fixture to which the lamp is connected or within the lamp itself. U.S. Pat. No. 3,869,631 is an example of the latter, in which a diode is provided in the lamp base for clipping the line voltage to reduce RMS load voltage at the light emitting element. U.S. Pat. No. 6,445,133 is another example of the latter, in which transformer circuits are provided in the lamp base for reducing the load voltage at the light emitting element.

Factors to be considered when designing a voltage converter that is to be located within the lamp include the sizes of the lamp and voltage converter, costs of materials and production, production of a potentially harmful DC load on a source of power for installations of multiple lamps, and the operating temperature of the lamp and an effect of the operating temperature on a structure and operation of the voltage converter.

SUMMARY OF THE INVENTION

An object of the present invention is to provide a novel lamp that includes within the lamp a voltage conversion circuit for converting line voltage to a lower RMS load voltage, where the voltage conversion circuit includes a triac phase-controlled dimming circuit. The phase-controlled dimming circuit has a plurality of resistors connected in parallel, and each of the resistors is connected to a respective fuse that breaks at a different current. A resistance in the phase-controlled dimming circuit is set responsive to a voltage at the lamp terminal by breaking one or more of the fuses.

The triac phase-controlled dimming circuit may include a capacitor, a diac, a triac that is triggered by the diac, as well as the plural resistors.

The voltage conversion circuit may be an integrated circuit in a lamp base and connected between a lamp terminal and a light emitting element housed in the lamp light transmitting envelope.

DESCRIPTION OF PREFERRED EMBODIMENTS

Figure 1:
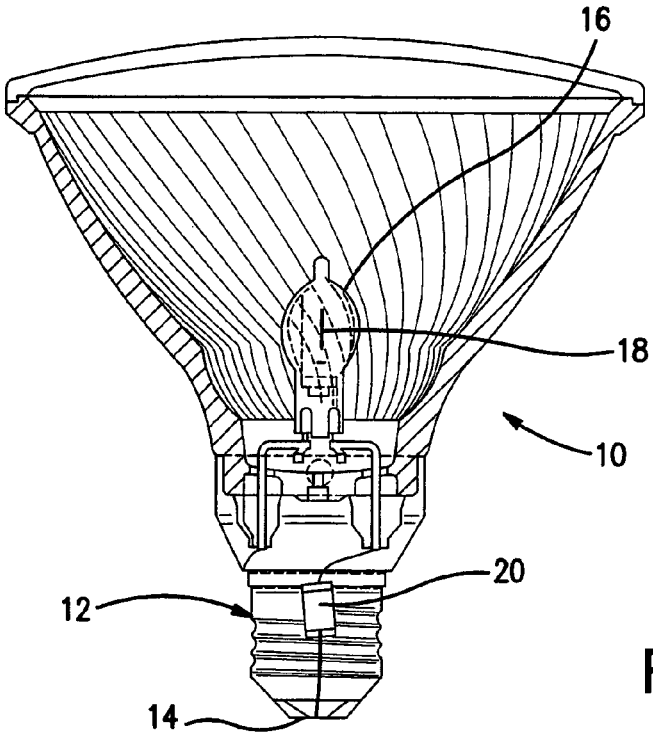
FIG. 1 is a partial cross section of an embodiment of a lamp of the present invention.

With reference to FIG. 1, a lamp 10 includes a base 12 with a lamp terminal 14 that is adapted to be connected to line voltage, a light-transmitting envelope 16 attached to the base 12 and housing a light emitting element 18 (an incandescent filament in the embodiment of FIG. 1), and a lamp voltage conversion circuit 20 for converting a line voltage at the lamp terminal 14 to a lower lamp operating voltage. The lamp voltage conversion circuit 20 is within the base 12 and connected between the lamp terminal 14 and the light emitting element 18. The voltage conversion circuit 20 may be an integrated circuit in a suitable package as shown schematically in FIG. 1.

While FIG. 1 shows the lamp voltage conversion circuit 20 in a parabolic aluminized reflector (PAR) halogen lamp, the lamp voltage conversion circuit 20 may be used in any incandescent lamp when placed in series between the light emitting element (e.g., filament) and a connection (e.g., lamp terminal) to a line voltage.

Figure 2:
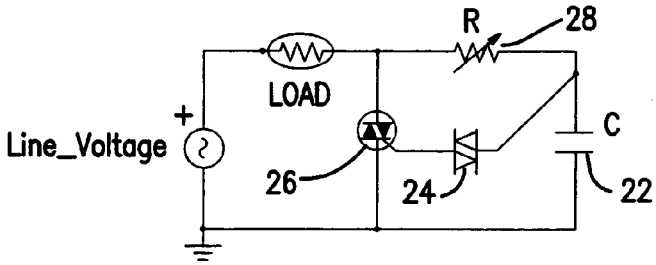
FIG. 2 PRIOR ART
FIG. 2 is a schematic circuit diagram of a phase-controlled dimming circuit of the prior art.

The voltage conversion circuit 20 includes a phase-controlled dimming circuit, derived from a conventional phase-controlled dimming circuit such as shown in FIG. 2 that has a capacitor 22, a diac 24, a triac 26 that is triggered by the diac 24, and resistor 28. In a conventional dimming circuit, the resistor 28 may be a potentiometer that sets a resistance in the circuit to control a phase at which the triac 26 fires. A dimming circuit is a two terminal device intended to reside in series with a relatively small resistive load.

Figure 3:
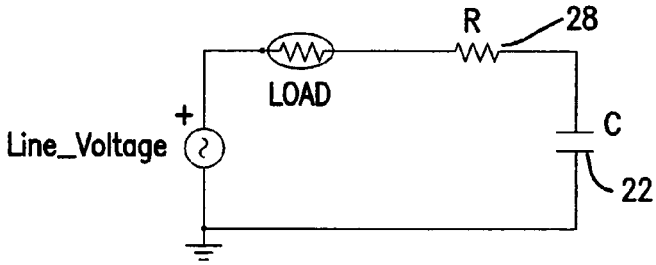
FIG. 3 PRIOR ART
FIG. 3 is a schematic circuit diagram of the phase-controlled dimming circuit of FIG. 2 showing an effective state in which the triac is not yet triggered.

In operation, a dimming circuit such as shown in FIG. 2 has two states. In the first state the diac 24 and triac 26 operate in the cutoff region where virtually no current flows. Since the diac and triac function as open circuits in this state, the result is an RC series network such as illustrated in FIG. 3. Due to the nature of such an RC series network, the voltage across the capacitor 22 leads the line voltage by a phase angle that is determined by the resistance and capacitance of the RC series network. The magnitude of the capacitor voltage is also dependent on these values.

Figure 4:
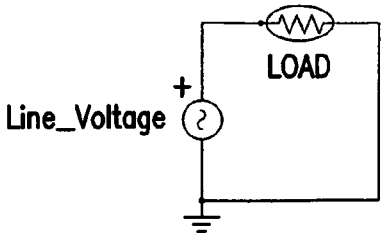
FIG. 4 PRIOR ART
FIG. 4 is a schematic circuit diagram of the phase-controlled dimming circuit of FIG. 2 showing an effective state in which the triac has been triggered.

The voltage across the diac 24 is analogous to the voltage drop across the capacitor 22 and thus the diac will fire once breakover voltage is achieved across the capacitor. The triac 26 fires when the diac 24 fires. Once the diac has triggered the triac, the triac will continue to operate in saturation until the diac voltage approaches zero. That is, the triac will continue to conduct until the line voltage nears zero crossing. The virtual short circuit provided by the triac becomes the second state of the dimming circuit, such as illustrated in FIG. 4.

Figure 5:
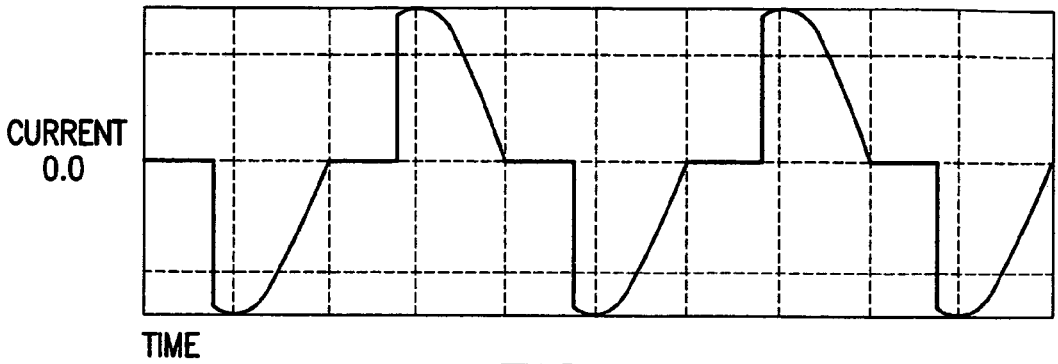
FIG. 5 PRIOR ART
FIG. 5 is a graph illustrating current clipping in the phase-controlled dimming circuit of FIG. 2.
Figure 6:
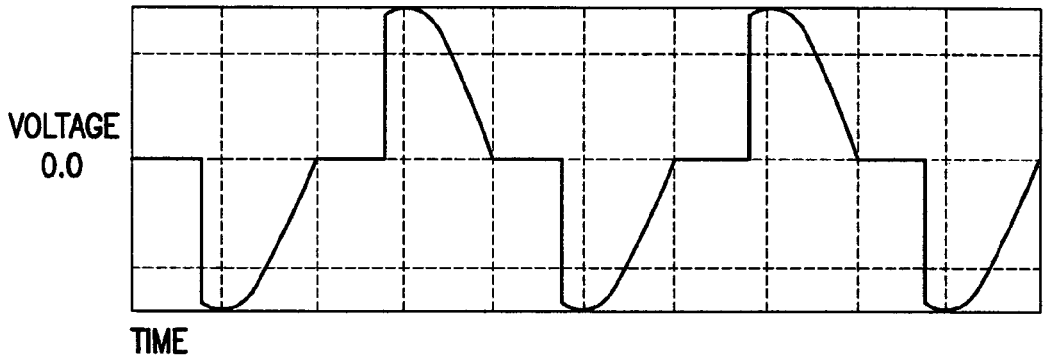
FIG. 6 PRIOR ART
FIG. 6 is a graph illustrating voltage clipping in the phase-controlled dimming circuit of FIG. 2.

Triggering of the triac 26 in the dimming circuit is phase-controlled by the RC series network and the leading portion of the mains voltage waveform is clipped until triggering occurs, as illustrated in FIGS. 5–6. A load attached to the dimming circuit experiences this clipping in both voltage and current due to the relatively large resistance in the dimming circuit.

Accordingly, the RMS voltage and current seen by the load are determined by the resistance and capacitance values in the dimming circuit since the phase at which the clipping occurs is determined by the RC series network and since the RMS voltage and current depend on how much energy is removed by the clipping.

Line voltage may vary from location to location up to about 10% and this variation can cause a variation in RMS load voltage in the lamp by an amount that can vary light levels, shorten lamp life, or even cause immediate failure. For example, if line voltage were above the standard for which the voltage conversion circuit was designed, the triac 26 may trigger early thereby increasing RMS load voltage. In a halogen incandescent lamp, it is particularly desirable to have a constant RMS load voltage.

Figure 7:
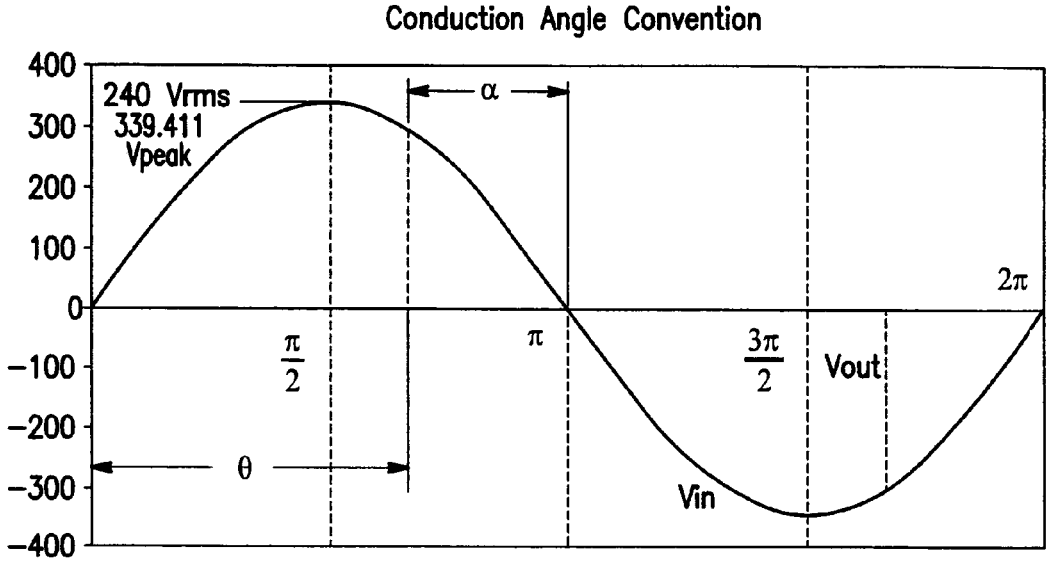
FIG. 7 is a graph showing the conduction angle convention adopted herein.

By way of background and with reference to FIG. 7, clipping is characterized by a conduction angle $\alpha$ and a delay angle $\theta$. The conduction angle is the phase between the point on the load voltage/current waveforms where the triac begins conducting and the point on the load voltage/current waveform where the triac stops conducting. Conversely, the delay angle is the phase delay between the leading line voltage zero crossing and the point where the triac begins conducting.

Define $V_{irrms}$ as RMS line voltage, $V_{ip}$ as peak line voltage, $V_{orms}$ as RMS load voltage, $V_{op}$ as peak load voltage, T as period, and $\omega$ as angular frequency (rad) with $\omega=2\pi f$. The RMS voltage is determined from the general formula:

$$V_{orms} = \sqrt{\frac{1}{T}\int_0^T v^2(t)\,dt}$$

Applying the conduction angle defined above yields:

$$V_{orms} = \sqrt{\frac{1}{2\pi}\left[\int_{\pi-\alpha}^{\pi} V_{ip}^2\sin^2(\omega)\,d\omega + \int_{2\pi-\alpha}^{2\pi} V_{ip}^2\sin^2(\omega)\,d\omega\right]}$$

$$V_{orms} = \sqrt{\frac{1}{2\pi}(2)\left[\int_{\pi-\alpha}^{\pi} V_{ip}^2\sin^2(\omega)\,d\omega\right]}$$

$$V_{orms} = \sqrt{\frac{V_{ip}^2}{\pi}\left(\frac{\alpha-\sin\alpha\cos\alpha}{2}\right)}$$

$$V_{orms} = V_{ip}\sqrt{\frac{\alpha-\sin\alpha\cos\alpha}{2\pi}}$$

This relationship can also be used to define $V_{ip}$ in terms of $V_{orms}$, and $\alpha$:

$$V_{ip} = V_{orms}\sqrt{\frac{2\pi}{\alpha-\sin\alpha\cos\alpha}}$$

Figure 8:
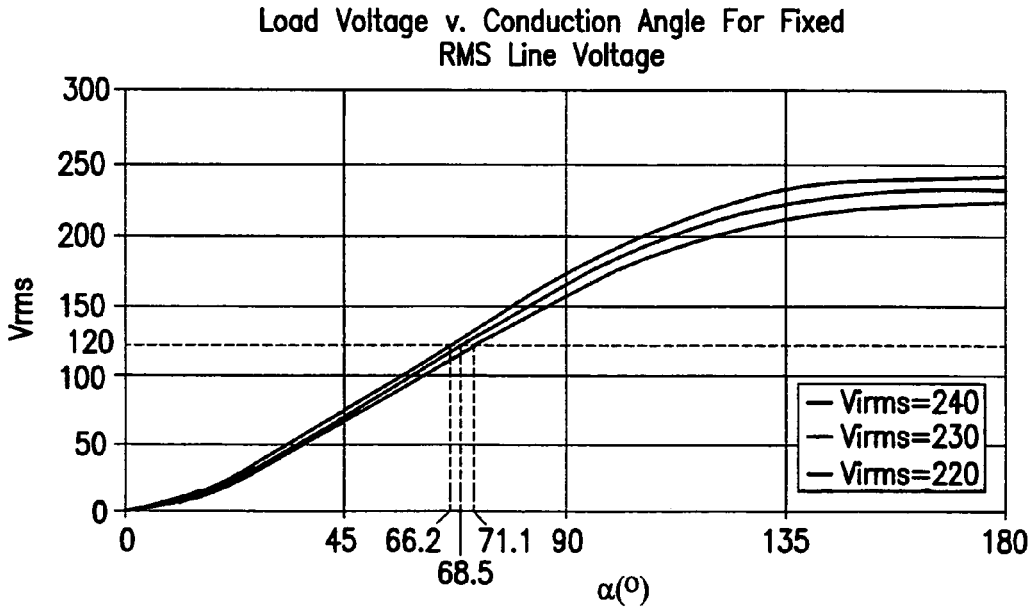
FIG. 8 is a graph showing the relationship of load voltage to conduction angle for several RMS line voltages.
Figure 9:
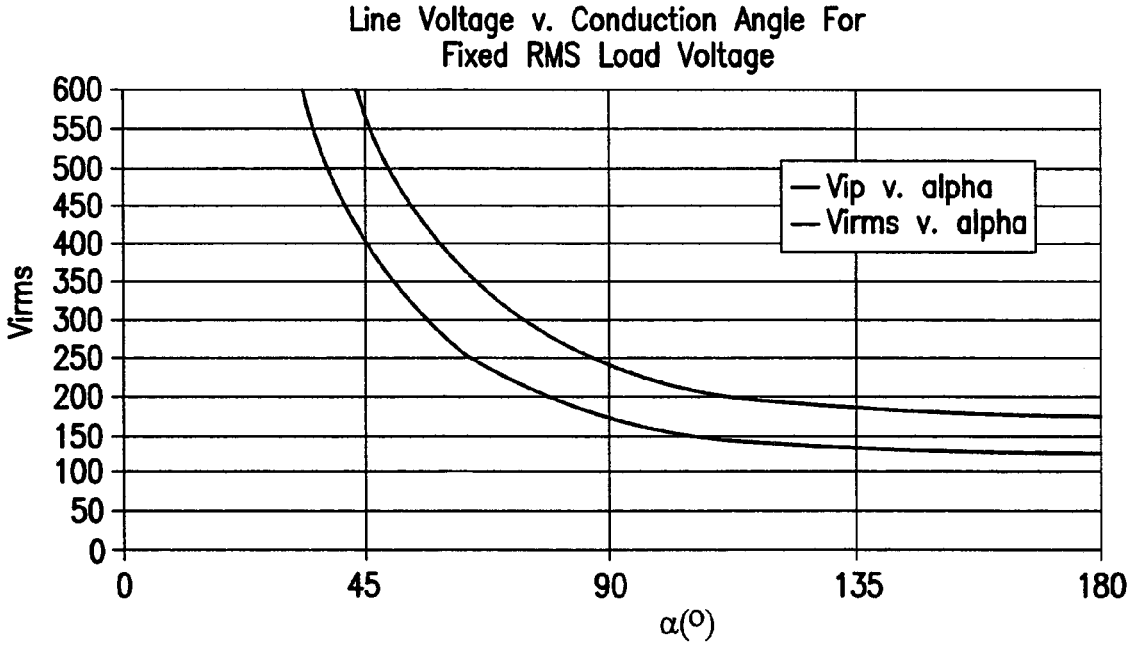
FIG. 9 is a graph showing the relationship of line voltage to conduction angle for fixed RMS load voltages.

Using these equations, the relationship between peak line voltage, RMS line voltage, RMS load voltage, and conduction angle a may be displayed graphically. FIG. 8 shows $V_{orms}$ as a function of conduction angle $\alpha$ for line voltages 220V, 230V and 240V. Note that small changes in line voltage result in larger changes in RMS load voltage. FIG. 9 shows the relationship of line voltage to conduction angle for fixed RMS load voltages. A lamp light emitting element (e.g., filament) is designed to operate at a particular load voltage, such as 120Vrms. As seen these graphs, the conduction angle required to achieve this load voltage depends on the RMS line voltage and the relationship is not linear. Changes in the line voltage are exaggerated at the load.

The solution proposed herein to the problem of varying line voltages is to provide a voltage conversion circuit that is capable of operating at one of several different locations that each have a particular line voltage, since line voltage does not vary very much at a location. To this end, an embodiment of the phase-controlled dimming circuit of the present invention shown in FIG. 10 includes plural resistors R1, R2, R3 connected to each other in parallel, where each of the resistors is series-connected to a respective fuse F1, F2, F3, each of which has a different breaking current corresponding to voltage present on the line. A resistance in the phase-controlled dimming circuit may be set for a particular location by breaking one or more of the fuses in response to the line voltage. For example, the resistance values in the dimming circuit could be optimized for 220V operation by breaking one fuse, while the same circuit could be optimized for 230V by breaking others of the fuses.

By way of explanation, note that for a network of parallel resistors, the equivalent resistance $R_{eq}$ is:

$$R_{eq} = \left[\frac{1}{R_1}+\frac{1}{R_2}+\frac{1}{R_3}+\ldots+\frac{1}{R_n}\right]^{-1}$$

Figure 10:
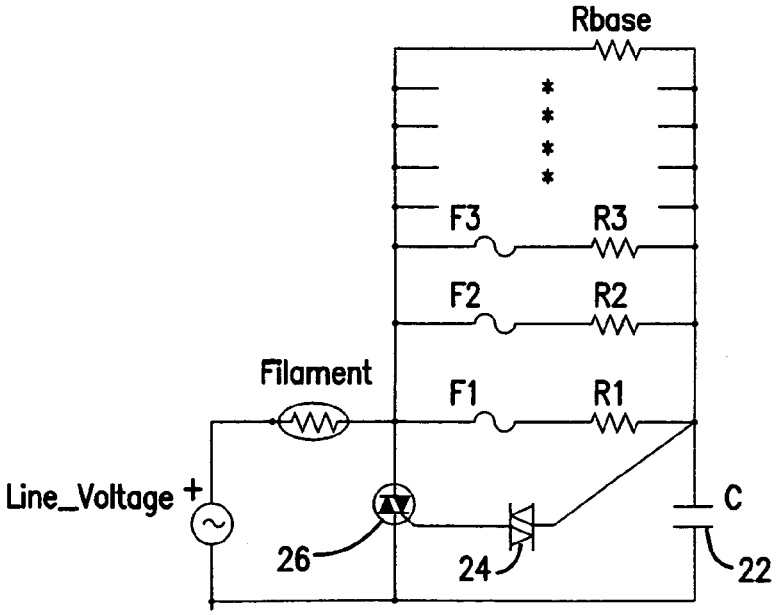
FIG. 10 is a schematic circuit diagram of a phase-controlled dimming circuit of an embodiment of the present invention.

Let the last resistor in the series be $R_{base}$ as shown in FIG. 10:

$$R_{eq} = \left[\frac{1}{R_1}+\frac{1}{R_2}+\frac{1}{R_3}+\ldots+\frac{1}{R_{base}}\right]^{-1}$$

As is apparent, $R_{eq}$ is less than or equal to $R_{base}$ for a network of parallel resistors. As resistors are removed from the network, $R_{eq}$ increases and it approaches the value of $R_{base}$. Thus, $R_{base}$ can be considered the maximum resistance in the network if all other resistors are removed.

Figure 11:
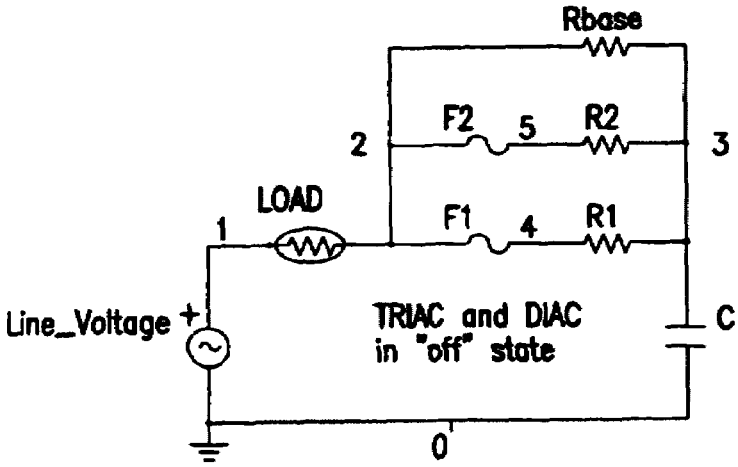
FIG. 11 is a schematic circuit diagram including an exemplary network of fused resistors.
Figure 12:
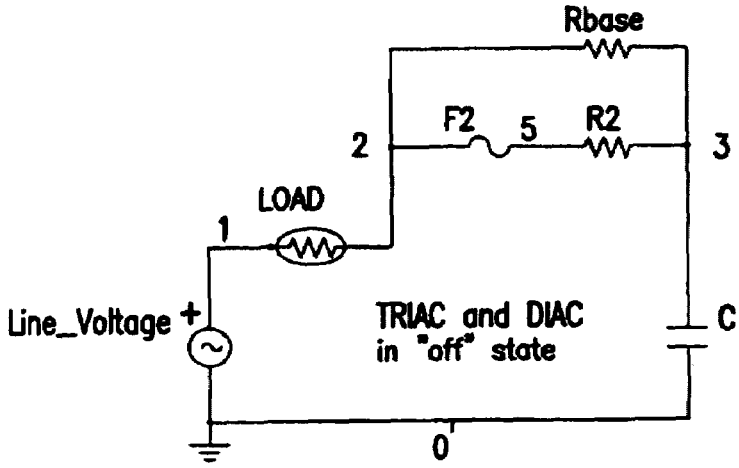
FIG. 12 is a schematic circuit diagram including the exemplary network of FIG. 11 with one fuse blown.
Figure 13:
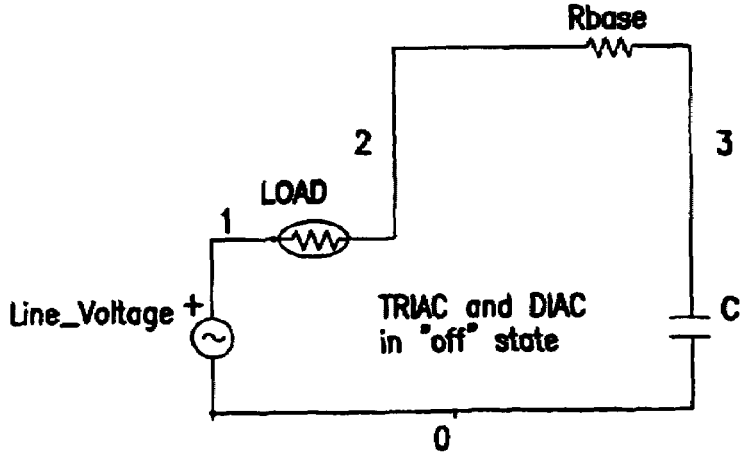
FIG. 13 is a schematic circuit diagram including the exemplary network of FIG. 11 with two fuses blown.

As an example, consider the triac dimming circuit of FIG. 11 that has three fuse-resistor branches. The fuses are set so that at the lowest line voltage, current drawn will not sufficient to break any of the fuses and the resistance of the dimming circuit will be set by the combined resistances of all three branches (the lowest resistance). If the dimming circuit is used where the line voltage is higher, sufficiently high so that one of the fuses breaks (FIG. 12), the resistor associated with the blown fuse will be removed from circuit, so that the resistance in the dimming circuit is now higher, and thus the triac triggers later to effectively reduce RMS load voltage. If the line voltage is high enough to blow both fuses (FIG. 13), both respective resistors are removed from the dimming circuit so that the resistance in the dimming circuit is $R_{base}$.

By way of further explanation, recall that the conduction angle of triac triggering is dependent on the RC series portion of the dimming circuit. When selecting the resistance and capacitance for a voltage conversion circuit, it is preferable to pick an appropriate capacitance and optimize the resistance. Consider how varying resistance affects triggering. For a simple RC series circuit (e.g., FIG. 3), the circuit resistance $R_T$ will be load resistance plus the resistance of the resistor. In application, the load resistance is very small compared to the resistance of the resistor and may be ignored. Using Kirchoff's voltage law the line source voltage $V_s$ can be written in terms of loop current I and element impedances:

$$V_s = I\left[R_T + \frac{1}{j\omega C}\right]$$

which may be rewritten:

$$I = \frac{j\omega C V_s}{j\omega R_T + 1}$$

This equation may be used to write an expression for the voltage across the capacitor:

$$V_c = I\frac{1}{j\omega C} = \frac{j\omega C V_s}{j\omega R_T C + 1}\left[\frac{1}{j\omega C}\right] = \frac{V_s(1 - j\omega R_T C)}{\omega^2 R_T^2 C^2 + 1}$$

The magnitude and phase relation of capacitor voltage with respect to reference line voltage can be calculated:

$$\mathrm{Im}\{V_c\} = \frac{-V_s \omega R_t C}{\omega^2 R_T^2 C^2 + 1}$$

$$\mathrm{Re}\{V_c\} = \frac{V_s}{\omega^2 R_T^2 C^2 + 1}$$

$$|V_C| = \sqrt{Im^2\{V_C\} + Re^2\{V_C\}} = \frac{V_s}{\sqrt{\omega^2 R_T^2 C^2 + 1}}$$

$$\angle\Theta_C = \tan^{-1}\left[\frac{\mathrm{Im}\{V_C\}}{\mathrm{Re}\{V_C\}}\right] = \tan^{-1}(-\omega R_T C)$$

The equations for capacitor voltage magnitude and phase delay show how the value of $R_T$ affects triggering. Diac triggering occurs (and thus triac triggering also occurs) when $V_C$ reaches diac breakover voltage. If capacitance and circuit frequency are fixed values, then $R_T$ and $V_S$ are the only variable that will affect the time required for $V_C$ to change to the diac breakover voltage. For a fixed location, $V_s$ varies minimally so it may considered approximately constant for the purposes of the present invention.

Figure 14:
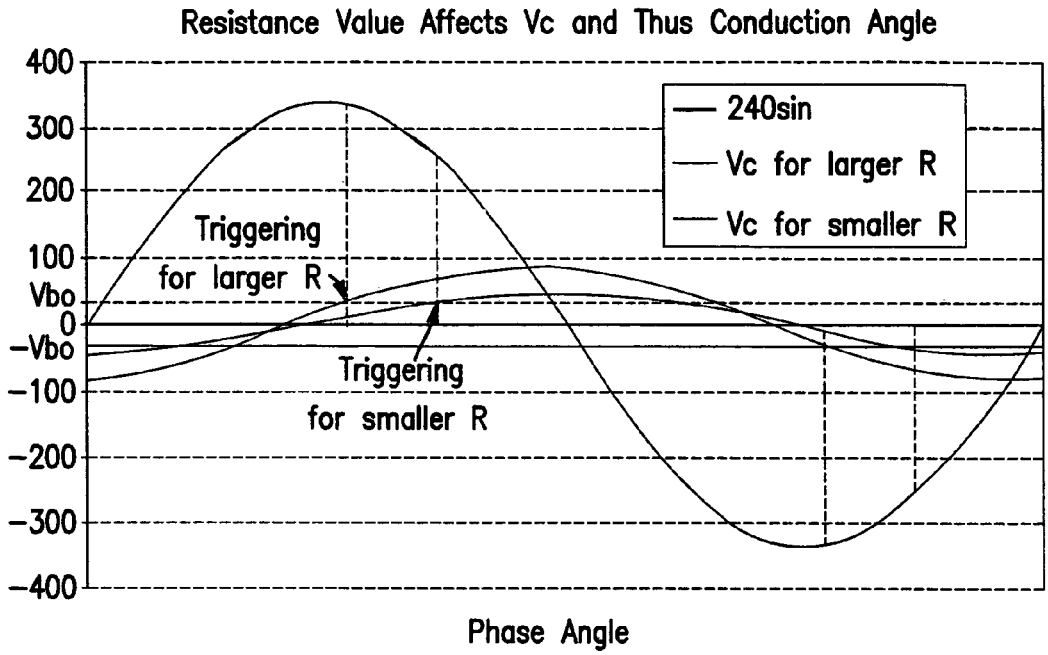
FIG. 14 is a graph showing how resistance affects capacitor voltage $V_C$ and thus conduction angle.

For a fixed $V_S$, as $R_T$ increases, $|V_C|$ decreases and $\theta_C$ becomes more negative. The result is a smaller conduction angle as shown in FIG. 14, and RMS load voltage decreases. For a fixed $V_S$, as $R_T$ decreases, $|V_C|$increases and $\theta_C$ becomes less negative. The result is a larger conduction angle as shown in FIG. 14, and RMS load voltage increases.

Figure 15:
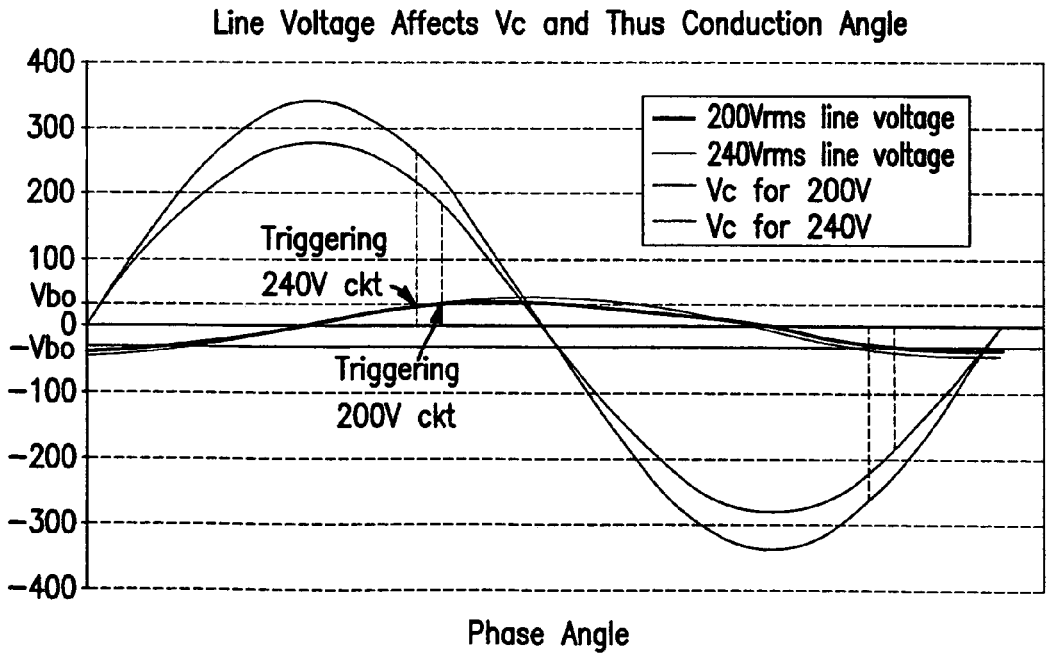
FIG. 15 is a graph showing how line voltage affects capacitor voltage $V_C$ and thus conduction angle.

By contrast, consider that if $R_T$ were fixed (if the fused resistor portion of the circuit were not present), as $V_S$ increases, $|V_C|$ increases and $\theta_C$ is unaffected. Thus, $V_C$ reaches diac breakover voltage more quickly. As a result, the conduction angle is larger as shown in FIG. 15. Thus, an increase in line voltage causes an undesirable exaggerated increase in load voltage. Similarly, as $V_S$ decreases, $|V_C|$ decreases and $\theta_C$ is unaffected. Thus, $V_C$ reaches diac breakover voltage less quickly and the result is a smaller conduction angle as shown in FIG. 15. Thus, a decrease in line voltage is seen as an exaggerated decrease in load voltage.

To avoid these exaggerated change in load voltage, the fused resistor/triac dimming circuit disclosed herein automatically adjusts $R_T$ by blowing one or fuses so that the conduction angle is set to produce the proper RMS load voltage for a particular location having a particular line voltage.

In a first embodiment, the lamp includes a lamp voltage converter, such as conversion circuit 20 within the lamp 10 and connected to a lamp terminal 14, where the voltage conversion circuit 20 includes a phase-controlled dimming circuit that has a plurality of resistors ($R_1$, $R_2$) connected in parallel and where each of the resistors is connected to a respective fuse ($F_1$, $F_2$) that breaks at a different current corresponding to voltage present at the line. A resistance in the phase-controlled dimming circuit is set in response to a load voltage at the lamp terminal by breaking one or more of the fuses.

In a second embodiment, the lamp includes a lamp voltage conversion circuit 20 in the lamp 10 and connected between a lamp terminal 14 and a light emitting element 18, where the voltage conversion circuit 20 converts a first line voltage at the lamp terminal 14 to a load voltage that operates the light emitting element 18. The voltage conversion circuit 20 includes phase-controlled dimming means for reducing an RMS load voltage at the light emitting element 18 and fused resistor means for fixing a resistance in the phase-controlled dimming means in reaction to the first voltage. The dimming means includes the dimming circuit discussed above and equivalents thereof while the fused resistor means includes the fused resistor circuit discussed above and equivalents thereof.

In a third embodiment, an incandescent lamp 10 includes base 12 with lamp terminal 14, light-transmitting envelope 16 attached to base 12 and housing light emitting element 18, and lamp voltage conversion circuit 20 for converting a first line voltage at the lamp terminal to a second RMS load voltage lower than the first voltage and that operates the light emitting element. The lamp voltage conversion circuit is within the base and connected between the lamp terminal and the light emitting element. The voltage conversion circuit includes a phase-controlled dimming circuit that has capacitor 22, diac 24, triac 26, and plural resistors $R_1$, $R_2$ connected to each other in parallel, each of the resistors being series-connected to a respective fuse $F_1$, $F_2$, each having a different breaking current corresponding to voltage present at the line. A resistance in the phase-controlled dimming circuit is fixed by breaking at least one said fuse in response to the first voltage.

A further embodiment is a method of setting a resistance in a voltage converter that is in a lamp and connected to a lamp terminal. The method includes the steps of providing in the voltage converter a phase-controlled dimming circuit with a plurality of resistors connected in parallel, each of the resistors being connected to a respective fuse that breaks at a different current corresponding to voltage present at the line, and breaking one or more of the fuses in response to a line voltage at the lamp terminal to set a resistance in the phase-controlled dimming circuit.

While embodiments of the present invention have been described in the foregoing specification and drawings, it is to be understood that the present invention is defined by the following claims when read in light of the specification and drawings.

We claim:

1. A lamp comprising:

a lamp voltage conversion circuit within the lamp and connected to a lamp terminal;

said voltage conversion circuit including a phase-controlled dimming circuit that has a plurality of resistors connected in parallel; and each of said resistors being connected to a respective fuse that breaks at a different current corresponding to a voltage present at a line, wherein a resistance in said phase-controlled dimming circuit is set responsive to a voltage at said lamp terminal by breaking one or more of said fuses.

2. The lamp of claim 1, wherein said phase-controlled dimming circuit further includes a capacitor, a diac, and a triac that is triggered by said diac.

3. The lamp of claim 1, further comprising a base and a light-transmitting envelope, and wherein said voltage conversion circuit is within said base.

4. The lamp of claim 1, wherein said voltage conversion circuit is an integrated circuit.

5. The lamp of claim 1, wherein each of said resistors is connected in series to the respective fuse.

6. The lamp of claim 1, further comprising a base resistor connected in parallel with said resistors, said base resistor defining a maximum resistance in said phase-controlled dimming circuit.

7. A lamp comprising a lamp voltage converter in the lamp and connected between a lamp terminal and a light emitting element, said voltage converter converting a first line voltage at said lamp terminal to a load voltage that operates said light emitting element, said voltage converter including phase-controlled dimming means for reducing an RMS load voltage at said light emitting element and fused resistor means for fixing a resistance in said phase-controlled dimming means in reaction to the first line voltage.

8. The lamp of claim 7, wherein said phase-controlled dimming means comprises a circuit that has a capacitor, a diac, a triac that is triggered by said diac, and said fused resistor means.

9. The lamp of claim 7, wherein said fused resistor means comprises plural resistors connected in parallel, where each of said resistors is connected in series to a respective fuse, each with a different breaking current corresponding to a voltage present at a line.

10. The lamp of claim 9, wherein said fused resistor means further comprises a base resistor connected in parallel with said plural resistors, said base resistor defining a maximum resistance in said phase-controlled dimming means.

11. An incandescent lamp comprising:

a base with a lamp terminal;

a light-transmitting envelope attached to said base and housing a light emitting element; and a lamp voltage conversion circuit for converting a first line voltage at said lamp terminal to a second RMS load voltage lower than the first line voltage and that operates said light emitting element, said lamp voltage conversion circuit being within said base and connected between said lamp terminal and said light emitting element, said voltage conversion circuit including a phase-controlled dimming circuit that has a capacitor, a diac, a triac that is triggered by said diac, and plural resistors connected to each other in parallel, each of said resistors being series-connected to a respective fuse, each said fuse having a different breaking current corresponding to a voltage present at a line, wherein a resistance in said phase-controlled dimming circuit is fixed by breaking at least one said fuse in response to the first line voltage.

12. The incandescent lamp of claim 11, wherein said voltage conversion circuit is an integrated circuit.

13. A method of setting a resistance in a voltage converter that is in a lamp and connected to a lamp terminal, the method comprising the steps of:

providing in the voltage converter a phase-controlled dimming circuit with a plurality of resistors connected in parallel, each of the resistors being connected to a respective fuse that breaks at a different voltage; and breaking one or more of the fuses in response to a line voltage at the lamp terminal to set a resistance in the phase-controlled dimming circuit.

* * * * *